United States Patent [19]

Hai-Ping

[11] Patent Number: 4,555,110

[45] Date of Patent: Nov. 26, 1985

[54] BALL-HITTING TRAINING DEVICE

[76] Inventor: Kuo Hai-Ping, No. 528-10, Jen-Ai Village, Jen-Teh Hsiang, Tainan Hsien, Taiwan

[21] Appl. No.: 618,840

[22] Filed: Jun. 8, 1984

Related U.S. Application Data

[63] Continuation-in-part of Ser. No. 462,333, Jan. 31, 1983, abandoned.

[51] Int. Cl.[4] ..... A63B 69/40

[52] U.S. Cl. ..... 273/26 E; 273/200 B

[58] Field of Search ..... 273/26 E, 26 R, 1 B, 273/202, 26 A, 29 A, 181 D, 185 D, 200 B

[56] References Cited

U.S. PATENT DOCUMENTS

| | | | |
|---|---|---|---|
| 983,315 | 2/1911 | Rubens | 273/26 E |
| 2,818,255 | 12/1957 | Ponza | 273/26 E |
| 3,794,320 | 2/1974 | Salmont | 273/26 E |
| 4,175,744 | 11/1979 | Llewellyn | 273/26 E |
| 4,508,339 | 4/1985 | Llewellyn | 273/26 E |

*Primary Examiner*—Richard C. Pinkham
*Assistant Examiner*—T. Brown

[57] ABSTRACT

This invention relates to a device for the training of ball-hitting, and in particular for the batting practice of baseball, softball, and the like. The ball can make irregular movement in axial, radial and angular directions at the same time, thus offering the ball an unpredicable position, while requiring no power to drive the device.

5 Claims, 7 Drawing Figures

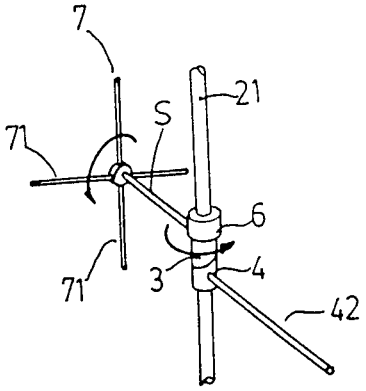
FIG. 4-A
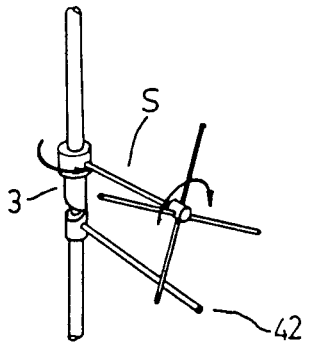
FIG. 4-B

BALL-HITTING TRAINING DEVICE

This invention is a continuation-in-part of the U.S. patent application Ser. No. 06/462,333, filed on Jan. 31, 1983, (abandoned) in the name of the same applicant, which relates to a training device for hitting balls such as golfballs and baseballs.

With the popularization of sports, golf and baseball seem to outclass the other single events. However, both of them necessitate a vast space. Under such situation, various devices were developed for their training indoors or in a limited open space, nevertheless none of them proved to be ideal because of several factors. Firstly, the known automatic pitcher for training batters is sophisticated and so expensive that few families can afford it, and its maintenance demands special knowledge. Secondly, in an inexpensive training device the baseball is suspended still by a cord. The unchangeable position of the ball soon makes the player get tired of this monotonous batting. After a hit, one has to trace the ball to get it back for next hit. Thirdly, the training location of golf, while far smaller than a real golf course, still necessitates a roomy space which outsizes an ordinary tennis court. Thus golf training is impossible to be performed domestically.

U.S. Pat. No. 2,818,255 disclosed a batting practice device, in which a cylindrical cam is utilized to cause the rising and falling of a ball. However, since the axial rising and falling of the cam periodically corresponds to the revolution of the ball around the shaft, the height of the ball soon becomes predictable, thus the interest of the user will be diminished.

Accordingly, it is the chief object of this invention to provide a batting practice device whereby the aforesaid drawbacks are obviated or mitigated.

According to a feature of this invention, a damping mechanism is provided to cause the irregular rotation of the ball around the main shaft.

Another feature of this invention, the irregularity of the rotation, is further enhanced by a shifting mechanism which alters the rotating radius of the damping device.

This invention is better understood when one reads in connection with the annexed drawing, wherein:

BRIEF DESCRIPTION OF THE DRAWING

FIGS. 4A and 4B show the function of the damping mechanism;

DETAILED DESCRIPTION OF PREFERRED EMBODIMENT

Figure 3:
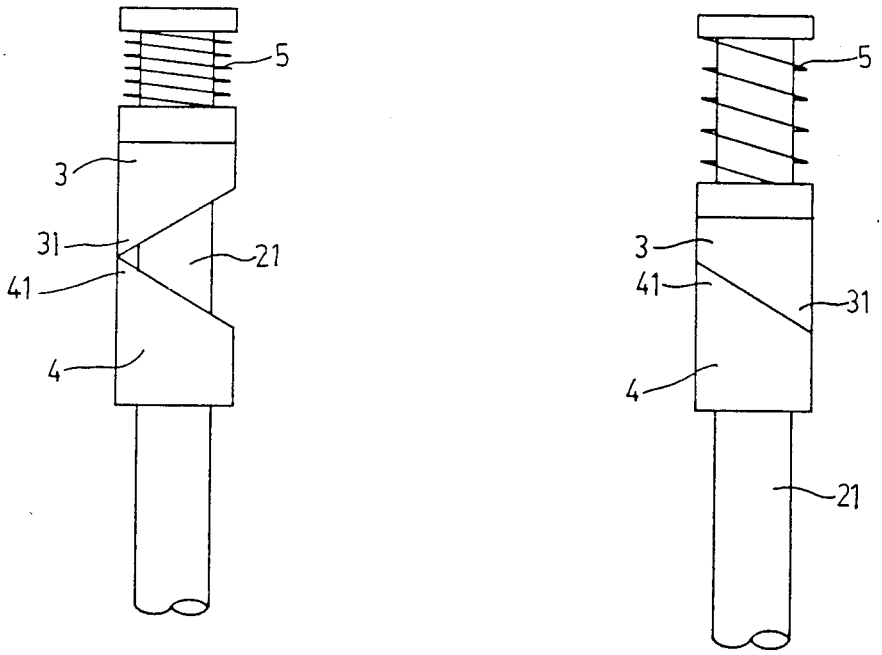
FIG. 3 is a perspective view of the cam members.
Figure 5:
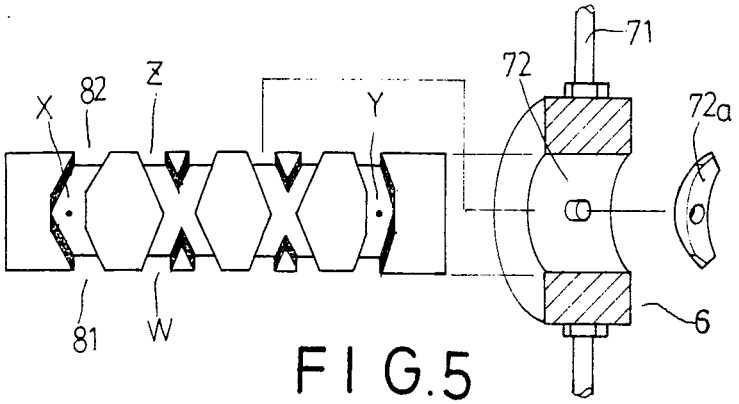
FIG. 5 is a side view of a double-thread guider which serves as the shifting mechanism.

Basically this invention is a batting practice device in which a ball (63) is mounted to a rotor (6) rotatable about a vertical main shaft (21) supported on a three-legged base stand. The ball (63) is fixed at one end of an L-shaped arm (61), the other end of which is secured to the rotor (6). The arm (61) is neither rotable nor axially movable relative to the rotor (61) but when the nut securing it to the rotor (6) is loosened, the distal portion of arm (61) can be swung about its proximal portion, to adjust the height of the ball (63). Rotor (6) is radially rotatably and axially slidably mounted on the shaft. When the ball is hit, it can spin swiftly about the main shaft. To cause the fluctuation of the height of ball (63), there are provided a cylindrical cam pair (3) (4), which comprises a free cam (3) and a fixed cam (4). Fixed cam (4) is fixedly mounted at a definite height of said shaft (21), while free cam (3) is located above said fixed cam (4) and is allowed to make free rotation about shaft (21) and axial sliding movement therealong. The free cam (3) is fixed to the rotor (6) by screws (64) to make co-rotation and co-sliding with the latter. As shown in FIG. 3, the ball is at its highest level when the apex (31) of free cam (3) and the apex (41) of fixed cam (4) meet each other, and at its lowest level when the two apexes (31) (41) are at opposite sides of the shaft (21). (At this moment, the two cams (3) (4) complementarily form a cylinder.) To ensure the two cams (3) (4) always in contact, a compression spring (5) is provided, with its upper end fixed to shaft (21) and its lower end urging against the upper rim of the free cam (3). The above description is not the feature of this invention, and is not described in further detail.

The two features of this invention consist in a damping mechanism which slightly decelerates the speed of the ball once for each turn, and means which cause the variation of the rotating radius of the damping mechanism, thereby further enhancing the unpredictability of the ball.

As stated before, the height of the ball periodically fluctuates with the cam, thus if the user stands at a definite spot, the ball always rises or sinks to the same height when reaching his hitting position, thus the user soon loses his interest for such too easy hitting. For this reason, this invention provides a damping mechanism which makes the spinning of the ball around the shaft more irregular. This is achieved by a damping rotor (7), which is freely rotatable about an axis (S) fixed to and extending radially from the rotor (6). To distinguish the rotation of the mass center of the damping rotor (7) around the main shaft (21) from the rotation of the damping rotor (7) about the radial axis (S), I hereinafter use the term "revolution of damping rotor (7)" to refer to the former, and "rotation of damping rotor (7)" to refer to the latter. The damping mechanism further comprises a damping bar (42) fixed to and extending radially from the main shaft (21). Preferably the axis (S) and the arm (61) are located at opposite sides of the rotor (6). The damping rotor (7) comprises a plurality of (in this embodiment, four) legs (71). As shown in FIGS. 4A and 4B, when the ball (63) is hit and the damping rotor (7) is caused to revolve around the shaft (21) from the position in FIG. 4A to that of FIG. 4B, one of it legs is "tripped" by the damping bar (42) traversing its path, and caused to rotate about axis (S). The "tripping" causes a slight deceleration of the damping rotor (7), and therefore, of the ball (63). Since the position where a leg is tripped is not definite, the motion of the ball becomes more unpredictable. To ensure that in each revolution there is always a leg (71) tripped by the bar (42), the length of a leg (71) is preferably not shorter than 1.4 times the height difference between the highest level of axis (S) and the level of bar (42). Also, the length of bar (42) must be greater than the distance from the rotor (7) to shaft (21). The irregularity of the revolution is further enhanced by the use of the cams, since if a leg is "tripped" when the rotor (6) is at a low level, the damping effect is stronger than when the rotor (6) is at a high level.

Figure 1:
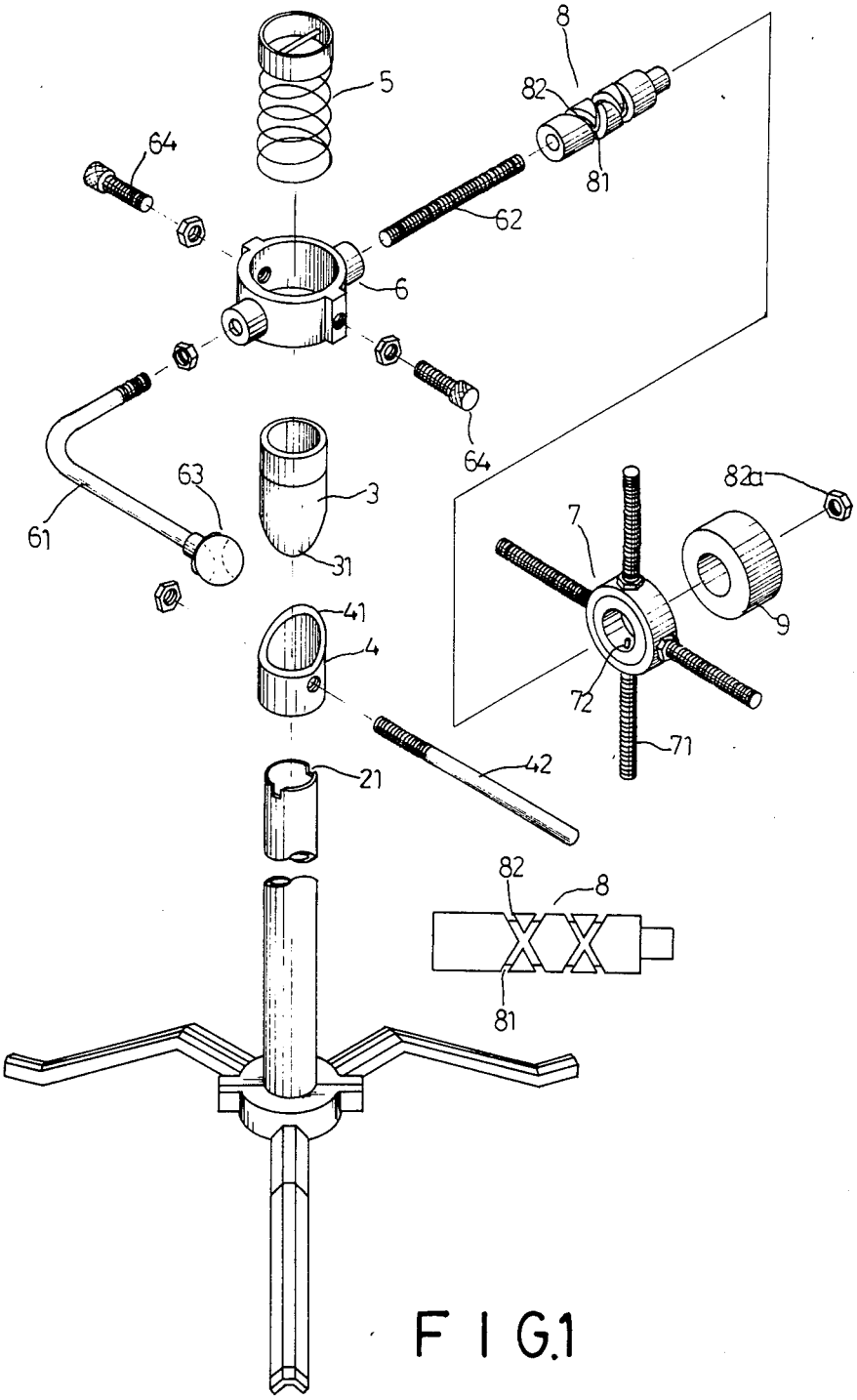
FIG. 1 is a fragmentary view of this invention.
Figure 2:
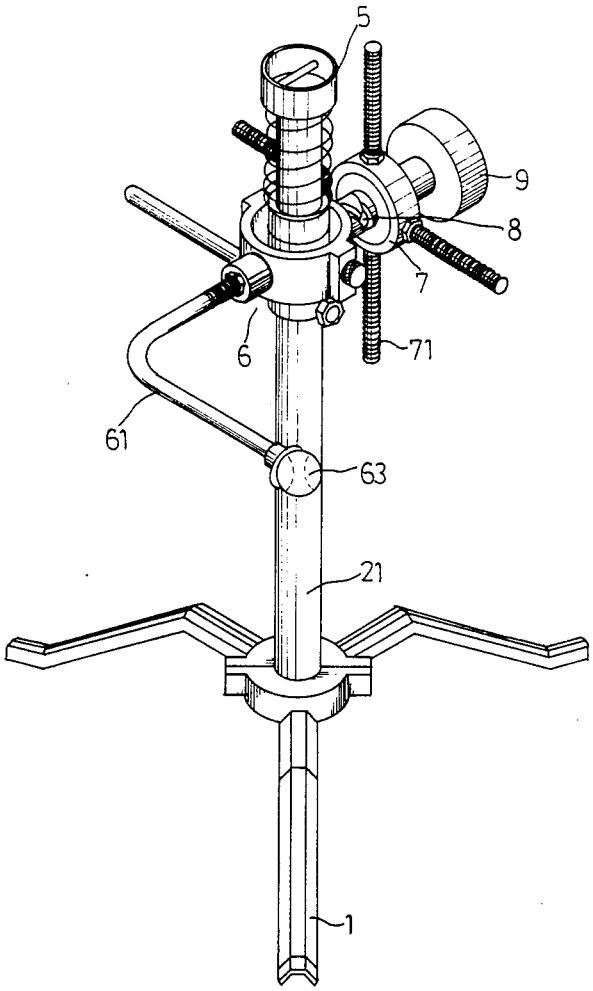
FIG. 2 is a perspective view of this invention.
Figure 6:
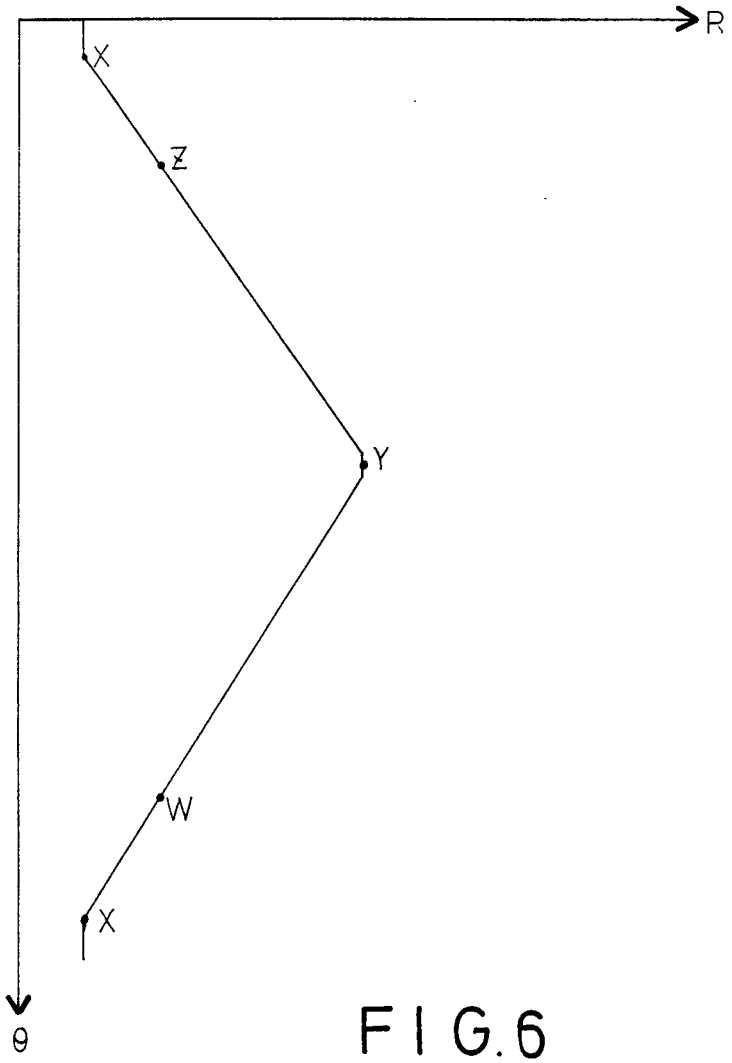
FIG. 6 is a graph showing the radial position of the damping device in relation to its angular position around the double-thread guider.

To further enhance the irregularity of the revolution of the damping rotor (7), there is provided a double-helicline guider (8) having two spiral grooves (81) (82), respectively with dextero-and levo-spirality. Here the term dextro- or levo-spirality refers to the direction of the winding of the helicline from the proximal end to the distal end of the guider (8), when viewed from the proximal end of the guider (8), is clockwise, or counter-clockwise. According to this definition, the spiral groove (81) is of dexterospirality, while (82), of levo spirality. Referring to FIG. 1, the guider (8) is immovably secured by means of a bolt (62) to rotor (6). The damping rotor (7) is internally fitted with guiding pin (72) which is fitted and guided in the groove (81) or (82) and can rotate around the guider (8) with accompanying axial shift. The rotor is retained within the grooved length of guider (8) by means of a retaining collar (9) and a nut (82*a*). As shown in FIG. 6, both ends of the two grooves (81) and (82) meet each other, so that if the damping rotor turns in clockwise direction, the guiding pin (72) starts, for example, from X, following the levo-spiral groove (82), passes through W, and reaches Y, then follows the dextro-spiral groove (81), passes through W, and returns to X, and then repeats the travel until the momentum of the ball is consumed up. FIG. 6 is a graph showing the relationship of the radial position of pin (72) and its rotating angle theta around the guider. Since the revolving radius (i.e. the distance from the damping rotor (7) to rotor (6)) is ever changing, the horizontal speed of the ball becomes more unpredictable.

The device can be converted into golf training by omitting the guider (8) and damping means, and replacing its base to lower the ball to a low level. Since the golf ball is often received on a tee, of which the position is fixed, no change of its position is necessary.

To further facilitate the guiding of the guider, there is provided a banana-shaped glider (72*a*), of which the contacting sides with said grooves (81) (82) and the interior of said rotor (6) are shaped to match the contours of the latter, and which is bored at its middle portion so that it can be rotatably mounted on pin (72) to make a slight deflection in both directions to align with the grooves (81) (82).

I claim:

1. A practice device for ball hitting, comprising:

a ball;

a vertically supported shaft;

a first rotor means to receive said ball at a horizontal distance from said shaft to allow said ball to co-rotate with the rotor to revolve horizontally around said shaft;

characterized by that a damping mechanism is provided to decelerate the revolution of said rotor, comprising a second rotor mounted to make rotation around a horizontal axis extending from said shaft, and hampering means not at the same height as the rotating center of said second rotor;

said second rotor having at least a protruding portion having a relatively large distal extension extending from its rotating center in the radial direction of said horizontal axis, said distal extension being such that when the second rotor revolves around said shaft, the protruding portion can impact upon said hampering means, yet the revolution of the second rotor is not stopped thereby, and the protruding portion can then pass over said hampering means by making rotation about said horizontal axis.

2. The practice device according to claim 1, wherein said second rotor comprises a plurality of projections extending a length in directions perpendicular to said horizontal axis, and said hampering means is a bar with its one end fixed to said shaft and horizontally extending a length greater than the horizontal distance from said second rotor to said shaft.

3. The device according to claim 1, further comprising means to change the distance from said second rotor to said shaft.

4. The device according to claim 3, wherein said means comprises a guider which is a cylindrical body with its axis coincident with said horizontal axis, and is provided with an endless groove, and said second rotor is internally provided with a projection inserted in said endless groove and guided therein.

5. The device according to claim 4, wherein said endless groove comprises two spiral grooves of opposite spirality around said guider and which meet with each other at both ends.

* * * * *